US005482107A

United States Patent [19]

Judd

[11] Patent Number: 5,482,107

[45] Date of Patent: Jan. 9, 1996

[54] CONTINUOUSLY CAST ELECTRICAL STEEL STRIP

[75] Inventor: Robert R. Judd, Crown Point, Ind.

[73] Assignee: Inland Steel Company, Chicago, Ill.

[21] Appl. No.: 192,056

[22] Filed: Feb. 4, 1994

[51] Int. Cl.[6] ..... A22D 11/06; A22D 11/00

[52] U.S. Cl. ..... 164/480; 164/476; 164/459

[58] Field of Search ..... 164/476, 459, 164/76.1; 29/527.7

[56] References Cited

U.S. PATENT DOCUMENTS

| | | | |
|---|---|---|---|
| 3,203,839 | 8/1965 | Takahashi | 148/113 |
| 3,834,952 | 9/1974 | Matsushita et al. | 148/112 |
| 3,867,211 | 2/1975 | Easton | 148/31.55 |
| 3,908,737 | 9/1975 | Matsunega et al. | 164/476 |
| 4,046,602 | 9/1977 | Stasnley | 148/111 |
| 4,204,890 | 5/1980 | Irie et al. | 148/111 |
| 4,331,196 | 5/1982 | Ohashi et al. | 164/476 |
| 4,421,574 | 12/1983 | Lyudkovsky | 148/111 |
| 4,555,264 | 11/1985 | Takeshita et al. | 164/459 |
| 4,715,905 | 12/1987 | Nakaoka et al. | 164/476 |
| 4,936,374 | 6/1990 | Pareg | 164/503 |
| 5,197,534 | 3/1993 | Gerber et al. | 164/467 |

FOREIGN PATENT DOCUMENTS

| | | | |
|---|---|---|---|
| 50-98425 | 8/1975 | Japan . | |
| 52-16420 | 2/1977 | Japan | 164/459 |
| 60-56021 | 4/1985 | Japan | 164/476 |
| 63-60227 | 3/1988 | Japan | 29/527.7 |
| 63-295044 | 12/1988 | Japan | 164/476 |
| 1514375 | 6/1978 | United Kingdom . | |

*Primary Examiner*—Kurt Rowan
*Assistant Examiner*—I. H. Lin
*Attorney, Agent, or Firm*—Marshall, O'Toole, Gerstein, Murray & Borun

[57] ABSTRACT

A molten silicon steel is continuously strip cast to a thickness approaching the aim final thickness of magnetic core laminations that are to be punched from the resulting steel strip. The strip is temper rolled and then annealed to produce stress relief and secondary grain growth. Recrystallization is avoided during cooling following strip casting and thereafter. The steel phase and predominant crystalline texture of the steel strip at its final thickness is the same as the steel phase and predominant crystalline texture that existed initially upon solidification from the molten state. The steel phase is body centered cubic. The crystalline texture is characterized by (100) planes of the unit cubes of the crystals lying in a plane of the strip parallel to the strip surface with random orientation of the (100) planes in that plane of the strip.

30 Claims, 1 Drawing Sheet

CONTINUOUSLY CAST ELECTRICAL STEEL STRIP

BACKGROUND OF THE INVENTION

The present invention relates generally to electrical steel strip and more particularly to electrical steel strip for core laminations for rotating electrical machinery and transformers and to a method, for producing such a strip, employing a continuous strip casting procedure.

Rotating electrical machinery, such as electric motors or generators, and transformers have magnetic cores comprising laminations made from electrical steel sheet or strip having relatively good magnetic properties such as relatively low core loss and relatively high magnetic permeability. Steel is composed of a multitude of crystals or grains comprising unit cubes in which the atomic distribution is described as either body-centered-cubic (b.c.c.) or face centered cubic (f.c.c.). In a body centered cube, there are atoms at each of the eight corners of the cube and one atom in the center of the cube. In a face centered cube, there are atoms at each of the eight corners of the cube and atoms in the center of each of the six faces of the cube. There are multitudes of unit cubes in a crystal which, in turn, is typically microscopic in size.

At room temperature, a principal constituent of most steels is a solid phase called ferrite (also called alpha) which is a body-centered-cubic phase. Depending upon its composition, at elevated temperatures, the steel can undergo a phase change wherein some or all of the ferrite can change to another phase called austenite (also called gamma) which is face-centered-cubic. The higher the temperature, the greater the proportion of austenite. At still higher temperatures, and depending upon the composition of the steel, some or all of the austenite can change into a body-centered-cubic phase called delta. When such a steel solidifies from the molten state and cools to room temperature, the solid steel undergoes phase changes in the following sequence: delta (b.c.c.) to austenite (f.c.c.) to ferrite (b.c.c.). For purposes of this discussion, the delta and ferrite phases may be assumed to be the same, and they will hereinafter be referred to interchangeably as b.c.c. phase.

The crystalline texture of a steel strip is determined by the alignment, with the surface of the strip, of one of three relevant planes of a unit cube. A unit cube, whether it be b.c.c. or f.c.c, has one relevant plane, defined by a face of the cube, called the (100) plane. Another relevant plane of the unit cube extends diagonally in one direction from one cube edge to a diagonally opposite and parallel edge of the cube, and this plane is called the (110) plane. A third plane of the unit cube extends in two diagonal directions, from one corner of the cube to a diagonally opposite corner of the cube, and this third plane is called the (111) plane. The crystalline texture of a steel can be described by the alignment of one of these three planes of the unit cube with the surface of the steel strip and by the alignment of one of the direction vectors in the chosen plane with the sheet rolling direction. Depending upon the thermo-mechanical processing to which the steel strip has been subjected, in some cases a (100) plane of the unit cubes may lie in or be parallel to the surface of the strip; in other cases a (110) plane of the unit cubes may lie in or be parallel to the surface of the strip; and in still other cases a (111) plane of the unit cubes may lie in or be parallel to the surface of the strip.

For rotating electrical machinery, the best magnetic properties are obtained when a (100) plane of the unit cubes lies in or is parallel to the surface of the strip and these {100} planes are randomly oriented therein. Such a random orientation has its direction vector designated as <uvw>. A random orientation means that the {100} planes lying in the surface of the strip (or in a plane parallel thereto) are rotated about an edge of the unit cube extending perpendicularly to the strip surface, with the {100} planes of different cubes rotated different amounts.

Steel strip is normally the end product of a manufacturing method employing a number of thermo-mechanical processing steps. Typically, the steel strip has undergone hot rolling, cold rolling and annealing steps, some or all of which may have changed the crystalline texture of the strip. To produce the desired crystalline texture (in which a (100) plane of the unit cubes lies in the surface of the strip or in a plane parallel thereto, with these {100} planes being randomly oriented in that plane of the strip) has conventionally required a relatively complicated sequence of thermo-mechanical processing steps.

Another procedure for producing steel strip is known as continuous strip casting. In this procedure, molten steel is poured into the gap defined between two counter-rotating, cooled rolls having facing surfaces which define the casting mold. As the molten steel descends through the gap between the two rolls, the steel is cooled and solidified so that a solid strip of steel exits downwardly from the nip (i.e. the narrowest part of the gap) between the rolls. The thickness of the strip is determined by the width of the nip between the rolls. The solidified strip is then cooled to ambient temperature. Depending upon its composition, a steel undergoing continuous strip casting will, during solidification and cooling to ambient temperature, undergo a change in phase from b.c.c. to f.c.c. to b.c.c., and each such phase change disrupts the crystalline texture which prevailed during the preceding phase.

In addition to procedures employing two counter-rotating rolls, there are other continuous strip casting procedures employing a single roll or continuous belts; all of these procedures are known to those skilled in the art of continuous strip casting.

Examples of continuous strip casting procedures and equipment are described in Gerber, et al. U.S. Pat. No. 5,197,534, Gerber U.S. Pat. No. 5,279,350, Pareg [sic.] U.S. Pat. No. 4,936,374 and Praeg U.S. Pat. No. 5,251,685 and in Blazek, et al. U.S. application Ser. No. 07/928,848 filed Aug. 11, 1992, for example; and the disclosures of these patents and of said application are incorporated herein by reference.

An advantage of continuous strip casting is that it usually eliminates the need to perform hot rolling and associated other procedures. When reference is made herein to the elimination or absence of hot rolling, that does not exclude (a) the use of guide rollers for directing the hot strip as it exits the strip caster and moves downstream thereof or (b) the use of rolls to ameliorate small gage variations (i.e. non-uniformity of thickness) in the strip exiting the strip caster.

SUMMARY OF THE INVENTION

The present invention is directed to an electrical steel strip from which one is to punch core laminations for rotating electrical machinery or transformers and to a method for producing that strip. The strip has a predominant crystalline texture characterized by a (100) plane of the unit cubes lying in a plane of the strip parallel to the surface of the steel strip with these {100} planes being randomly oriented in that plane of the strip.

The method comprises providing a molten lamination steel having a composition comprising sufficient ferrite stabilizers (a) to provide a b.c.c. phase in the steel initially upon solidification thereof and (b) to maintain the b.c.c. phase during cooling of the steel to ambient temperature following solidification. A typical ferrite stabilizer is silicon in the range 1.5–10–0 wt. %, for example, preferably 2.0–3.0 wt. %.

The molten steel is subjected to a continuous strip casting step to produce a strip having an initial thickness less than about 110% of the aim final thickness of the strip, preferably less than about 105%. (The strip's aim final thickness is that thickness at which the core laminations are to be punched.) The continuous strip casting step comprises solidifying the molten steel into a strip that, initially upon full solidification, comprises a predominantly dendritic steel microstructure having a b.c.c. phase and a predominant crystalline texture characterized by a (100) plane of the unit cubes lying in a plane of the strip parallel to the surface of the steel strip, with these {100} planes being randomly oriented in that plane of the strip.

A dendritic microstructure here is one in which crystals or grains, called dendrites, grow from the surface or near-surface of the solidifying strip inwardly, in the direction of heat extraction, and in this case, towards the center of the strip, so that the longitudinal axis of a dendrite extends from the strip surface inwardly toward the center of the strip. Edges of the unit cubes in the dendrite are aligned in the same direction as the longitudinal axis of the dendrites; other cube edges are perpendicular thereto. A direction along a cube edge is the so-called [100] direction of the unit cube. A (100) plane of the unit cube is perpendicular to a [100] direction (i.e. the edge of the cube) and, because a [100] direction of the unit cubes is perpendicular to the strip surface, a (100) plane of the unit cubes lies in a plane parallel to the strip surface.

Each dendrite has cross arms or branches which extend perpendicularly to the longitudinal axis of the dendrite. Some edges of the unit cubes in the cross arms are perpendicular to the longitudinal axis of the dendrite, and some cube edges are parallel thereto. There is a (100) plane, in these unit cubes, that is perpendicular to the latter group of cube edges and that therefore lies in a plane of the strip parallel to the strip surface. As used herein the terms "plane of the strip" or "strip plane" can include both (a) the plane of the strip surface and (b) planes within the strip which are parallel to the strip surface.

The crystalline texture described in the two preceding paragraphs is the predominant texture. There can be some unit cubes having no (100) plane lying in a plane of the strip parallel to the strip surface, but most unit cubes do.

Due to the composition of the steel, the predominant steel phase obtained upon initial solidification is b.c.c., and that phase is retained as the solidified steel strip cools to ambient temperature.

The method comprises providing the steel strip with its aim final thickness. This is accomplished, to the extent possible, primarily in the continuous strip casting step. In other words, the distance between the rolls at the nip corresponds as closely as practicable to that required to provide the aim final thickness of the strip. To the extent necessary, the strip is cold reduced after casting to obtain the aim final thickness and/or to impart the desired flatness to the strip. The amount of cold reduction in this step, a temper rolling step, is less than about 10%, preferably less than about 5% and most. preferably 0.5–1.0%.

After temper rolling, the strip is annealed under conditions that (a) relieve the stress imparted to the strip during any of the preceding steps and (b) provide secondary grain growth while (c) avoiding recrystallization. Recrystallization is avoided because that could disrupt the desireable crystalline texture which formed and was retained in the strip during solidification and cooling to ambient temperature. Secondary grain growth is grain growth which can occur without any change in the predominant crystalline texture that existed at the time grain growth began. The entire method is devoid of any step after the continuous strip casting step which substantially changes the b.c.c. phase and the crystalline texture that existed in the strip initially upon full solidification.

The resulting steel strip is characterized by the following features. There is a microstructure that has a b.c.c. phase, that is substantially unrecrystallized and that is predominantly dendritic with the longitudinal axis of the dendrites being perpendicular to the plane of the strip surface. There is a predominant crystalline texture characterized by a (100) plane of the unit cubes lying in a plane of the strip parallel to the strip surface with these {100} planes being randomly oriented in that plane of the strip. The steel composition includes at least one ferrite stabilizer in sufficient amount (a) to have provided a b.c.c. phase in the steel, initially upon solidification, and (b) to have maintained the b.c.c. phase during cooling to ambient temperature following solidification. The strip has a final thickness from which laminations can be punched.

After the laminations have been punched by a customer of the steel strip manufacturer, it may be desireable to subject the laminations to an additional stress relief anneal solely to eliminate the stresses at the edges of the laminations resulting from the punching step. It is not necessary to subject these laminations to a decarburizing step before the laminations are punched, nor is it necessary to subject the strip to a decarburizing step at any stage. This is because the composition of the molten steel from which the strip was cast had a carbon content sufficiently low (i.e. substantially less than 0.01 wt. %) as to obviate the need to conduct any decarburizing step after the molten steel has solidified.

Other features and advantages are inherent in the method and product claimed and disclosed or will become apparent to those skilled in the art from the following detailed description in conjunction with the accompanying diagrammatic drawings.

DETAILED DESCRIPTION

Figure 1:
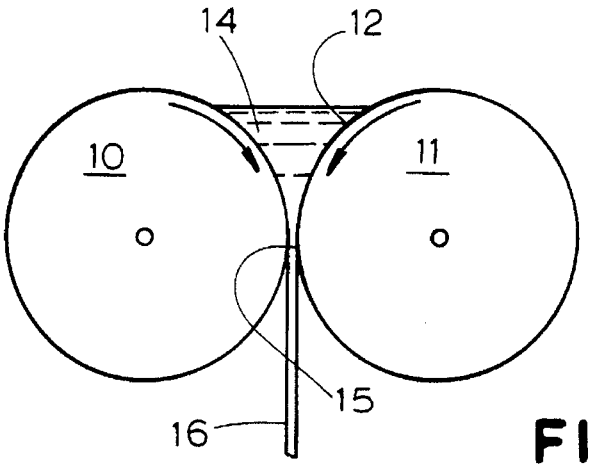
FIG. 1 is a diagrammatic view showing a continuous strip casting method.

A method in accordance with embodiments of the present invention produces an electrical steel strip having an aim final thickness from which are to be punched core laminations for rotating electrical machinery (e.g. electrical motors and generators) or transformers. The strip has a predominant crystalline texture characterized by a (100) plane of the unit cubes lying in a plane of the strip parallel to the surface of the steel strip, with a <uvw> direction in these {100} planes in the rolling direction, that is, a random orientation of these {100 } planes in that plane of the strip.

An initial step of the method comprises providing a molten lamination steel having a composition comprising sufficient ferrite stabilizer (a) to provide a body-centered-cubic (b.c.c.) phase in the steel initially upon solidification thereof and (b) to maintain the b.c.c. phase during cooling of the steel to ambient temperature following solidification. Objectives (a) and (b) can be accomplished by either (1) limiting the amount of austenite stabilizer(s) in the molten steel composition and/or (2) providing the molten steel composition with a sufficient amount of ferrite stabilizer(s). With respect to the austenite stabilizers, these may be limited as follows, in wt. %:

| | |
|---|---|
| carbon | 0.01 max. |
| manganese | 0.20 max. |
| nickel | 0.05 max. |
| chromium | 0.05 max. |
| copper | 0.10 max. |

The total amount of all austenite stabilizers must be consistent with accomplishing objectives (a) and (b) in a given composition. With respect to ferrite stabilizers, these may be provided as follows, in wt. %:

| | |
|---|---|
| silicon | 1.5–10.0 |
| aluminum | up to 5.0 |
| phosphorus | up to 2.0 |

In some embodiments, the molten steel composition may contain 1.5–10.0 wt. % silicon and at least one of (a) 0.5–5.0 wt. % aluminum and (b) 0.10–2.0 wt. % phosphorus.

Further with respect to carbon content, this element is limited not only to avoid the formation of austenite during cooling of the solidified steel, but also to obviate any need for subsequent decarburization of the steel strip or of laminations punched from the steel strip. Accordingly, the carbon content of the molten steel preferably is substantially less than 0.01 wt. % and most preferably less than 0.005 wt. %. The desired carbon content can be obtained by subjecting the molten steel to a vacuum-oxygen decarburization (VOD), or a so-called RH-OB procedure, or some similar procedure, all of these being conventional expedients heretofore utilized to reduce the carbon content to the amount described in the preceding part of this paragraph.

Examples of some embodiments of (A) broader and (B) narrower ranges of steel compositions in accordance with the present invention are tabulated below. Such compositions may consist essentially of the following ingredients, in wt. %.

| | (A) | (B) |
|---|---|---|
| carbon | less than 0.01 | less than 0.005 |
| manganese | 0.5 max. | 0.05–0.2 |
| sulfur | 0.005 max. | less than 0.001 |
| phosphorus | 0–0.10 | 0.002 max. |

-continued

| | (A) | (B) |
|---|---|---|
| silicon | 1.5–10.0 | 2.0–3.0 |
| aluminum | 0–0.50 | less than 0.01 |
| iron | essentially the balance | essentially the balance |

Four examples of steel compositions in accordance with the present invention are tabulated below. The elements are listed in wt. %. In each example, the balance consists essentially of iron.

| | 1 | 2 | 3 | 4 |
|---|---|---|---|---|
| carbon | 0.004 | 0.003 | 0.005 | 0.002 |
| manganese | 0.10 | 0.20 | 0.18 | 0.15 |
| sulfur | 0.002 | 0.003 | 0.001 | 0.001 |
| phosphorus | 0.02 | 0.01 | 0.001 | 0.12 |
| silicon | 3.5 | 3.0 | 5.0 | 2.25 |
| aluminum | 0.01 | 0.15 | 0.008 | 0.55 |
| nickel | 0.05 | 0.04 | 0.03 | 0.05 |
| chromium | 0.05 | 0.04 | 0.04 | 0.03 |
| copper | 0.10 | 0.08 | 0.10 | 0.05 |

After the desired composition has been attained, the molten lamination steel is subjected to a continuous strip casting step to produce a strip having an initial thickness less than about 110% of the aim final thickness for the strip. FIG. 1 is a diagrammatic illustration of strip casting. A pair of water cooled, counter-rotating rolls 10, 11 define therebetween a gap 12 into which is introduced molten steel to form a pool 14 of molten steel in gap 12. The molten steel is cooled as it flows downwardly between rolls 10, 11 and exits the gap as a solidified steel strip 16 the thickness of which is determined by roll nip 15 (i.e. the narrowest distance between the rolls). The gap between rolls 10, 11 has open, opposite gap ends, at opposite ends of rolls 10, 11, and the open gap ends are closed by electromagnetic dams, for example. Such dams are described in the prior art references directed to continuous strip casting and identified above at the end of the section entitled BACKGROUND OF THE INVENTION.

Figure 3:
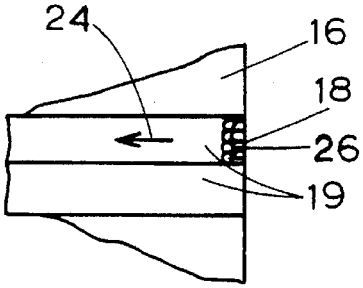
FIG. 3 is a fragmentary sectional view illustrating the direction of dendritic growth during a continuous strip casting process.
Figure 4:
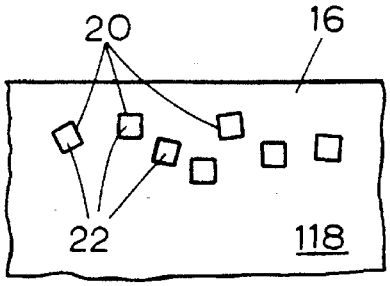
FIG. 4 is a fragmentary plan view illustrating the random orientation of a (100) plane of the unit cubes, in a plane parallel to the surface of a strip made in accordance with an embodiment of the present invention.

Initially, upon full solidification, the steel strip comprises a predominantly dendritic, steel microstructure having a b.c.c. phase and a predominant crystalline texture characterized by a (100) plane of the unit cubes of the crystals or grains lying in a plane of the strip parallel to the surface of the steel strip with these {100} planes being randomly oriented in that plane of the strip. This is all illustrated in FIGS. 2–4, as will be discussed more fully below.

Figure 2:
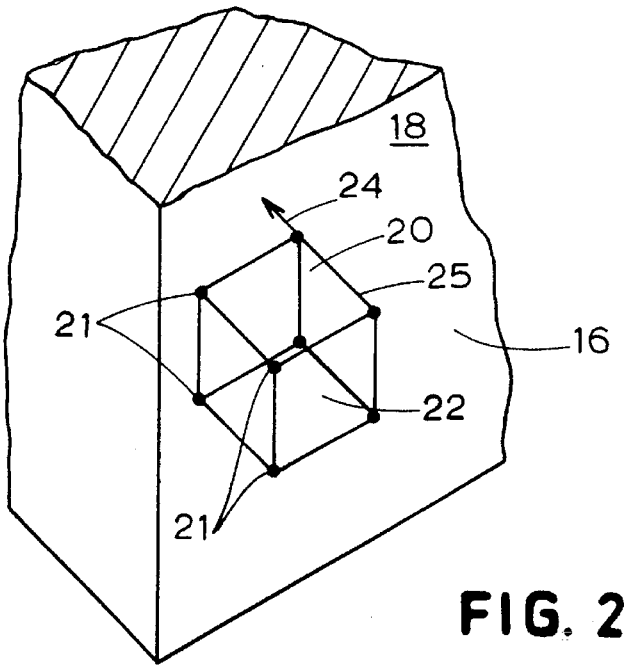
FIG. 2 is an exaggerated perspective of a unit cube of a crystal disposed in a continuously cast strip in accordance with an embodiment of the present invention.

The solidified steel strip 16 has a strip surface 18. During casting of strip 16 at rolls 10, 11, solidification began at strip surface 18 and proceeded inwardly toward the center of the strip in the direction indicated by arrow 24 in FIGS. 2 and 3. Solidification in this manner formed elongated crystals or dendrites 19 composed of unit cubes illustrated exaggeratedly at 20. Cubes 20 are body-centered cubes due to the fact that the molten steel had a composition which formed a delta phase initially upon solidification. In FIG. 2, unit cube 20 is shown as having atoms 21 at each of the eight corners of the cube. Not shown is the atom disposed in the center of the body-centered cube.

As previously noted, solidification occurs in the direction of arrow 24. A preponderance of unit cubes 20 in dendrite 19 have respective cube edges 25 aligned in the direction of arrow 24 which is perpendicular to strip surface 18. A (100)

plane 22 of each such unit cube 20 is perpendicular to cube edge 25 and is therefore perpendicular to the direction defined by arrow 24. As a result, there is a (100) plane 22 of the unit cubes that lies in a plane of the strip parallel to strip surface 18, and these {100} planes 22 are randomly oriented in that plane of the strip. In other words, referring to FIG. 4, there are many unit cubes 20 each having a (100) plane 22 in a plane 118 of the strip. Plane 118 is parallel to the surface of the steel strip. A (100) plane 22 of one unit cube 20 is rotated in plane 118, about a cube edge 25, a different amount than the rotation in plane 118 of other {100} planes 22 of other unit cubes 20 about their respective cube edges 25; this is a {100} <uvw> orientation using the well-known indices system of the English Crystallographer Miller.

Each dendrite 19 has cross arms or branches (not shown), and the predominant disposition of a (100) plane of the unit cubes in the cross arms is the same as the predominant disposition of a (100) plane of the unit cubes in the main stem of the dendrite, as described in the preceding paragraph.

Referring again to FIG. 3, one dendrite 19 is shown as having an outer end terminating at strip surface 18. In actual practice, there may be a very thin layer of substantially equiaxed grains 26 between the outer end of a dendrite 19 and strip surface 18. In accordance with the present invention, such equiaxed grains should be minimized because they do not have the desired crystalline texture: a predonderance of the unit cubes of the equiaxed grains do not have {100} planes which lie in a plane of the strip parallel to the strip surface.

After the continuous casting step illustrated in FIG. 1, strip 16 is cooled to ambient temperature. During such cooling, (a) the b.c.c. phase and (b) the desired predominant crystalline texture (described in the second and third preceding paragraphs above), both of which ((a) and (b)) existed initially upon full solidification, are substantially maintained. More particularly, because of the composition of the steel, there is no phase change from b.c.c. to f.c.c. to b.c.c. during cooling to ambient temperature. Because there is no phase change, there is no disruption of the crystalline texture which existed initially upon full solidification before cooling to ambient temperature.

Strip 16 is cooled to ambient temperature in a conventional manner, employing air cooling or the like, for example, consistent with providing a microstructure and predominant crystalline texture in accordance with the present invention.

In order to retain the desired crystalline texture (i.e. {100} planes of the unit cubes lying in a plane of the strip parallel to the strip surface, with these {100} planes being randomly oriented in that plane of the strip) one should avoid any subsequent processing of the strip which would disrupt that crystalline texture. More particularly, in order to avoid disruption of the desired crystalline phase, one should avoid any combination of mechanical and thermal processing steps which could cause grain recrystallization, for example. Grain recrystallization can occur as a result of hot rolling or as a result of heavy cold reduction followed by annealing at an elevated temperature. The employment of continuous strip casting eliminates the need to hot roll the strip. (However, as previously indicated, the elimination or absence of hot rolling does not exclude (a) the use of guide rollers for directing the hot strip as it exits the strip caster and moves downstream thereof or (b) the use of rolls to ameliorate small gage variations in the strip exiting the strip caster.)

Heavy cold reduction and recrystallization annealing are avoided by initially casting the strip to an initial strip thickness sufficiently close to the strip's aim final thickness as to avoid heavy cold reduction. Preferably, the initial strip thickness is less than 110% of the aim final thickness, and one need only employ a cold reduction less than about 10% (i.e. temper rolling) to provide the strip with its aim final thickness. More preferably, one need employ no more than about 5% cold reduction during temper rolling. Most preferably the initial strip thickness is sufficiently close to the aim final thickness as to require merely a very light temper roll to obtain the desired flatness of the strip, e.g. an initial strip thickness no more than about 101% of the aim final thickness followed by a flattening step employing cold reduction of no more than about 1% to provide the aim final thickness.

Typically, the strip has an aim final thickness in the range 0.010–0.100 inches (0.254–2.54 mm) and an initial thickness having a ratio to the final thickness in the range 101/100 to 110/100. Preferably the initial thickness is no greater than about 0.018 in. (0.46 mm), and the only temper rolling required is merely for flattening.

In summary, a method in accordance with the present invention is devoid of hot rolling and is preferably devoid of any cold rolling step other than temper rolling (less than about 10% cold reduction). More preferably, the method employs a temper rolling step which produces a cold reduction of less than about 5%, and most preferably, the temper rolling step comprises merely flattening the strip with a cold reduction in the range 0.5–1.0%.

After temper rolling, the strip is subjected to an annealing step under conditions that relieve stress and provide secondary grain growth while avoiding recrystallization. The anneal may be either a continuous anneal or a batch anneal. Typically, the anneal is conducted at a strip temperature of 500°–650° C. (932°–1202° F.), for example. When the anneal is a continuous anneal, the strip is held at the annealing temperature for about 1 minute; when the anneal is a batch anneal, the strip is held at the annealing temperature for about 5 hours. Time and temperature parameters for the annealing step are within the skill of the art; the important considerations being the provision of (1) stress relief and (2) (optionally) secondary grain growth, while (3) avoiding recrystallization.

Because recrystallization is avoided as a result of the constraints put upon cold reduction and heating following cooling to room temperature, and because of the absence of hot rolling, the phase and crystalline texture in the steel strip after temper rolling and annealing are the same phase and crystalline texture that existed in the strip when it was first cooled to ambient temperature; that phase and that texture in turn were the same as the phase and texture that existed in the strip initially upon full solidification, namely a b.c.c. phase and a crystalline texture characterized by a (100) plane of the unit cubes lying in a plane of the strip parallel to the surface of the steel strip with these {100} planes being randomly oriented in that plane of the strip (i.e. a {100} <uvw> texture).

In summary, the method is devoid of any step after the continuous strip casting step which substantially changes the b.c.c. phase and the crystalline texture from the phase and texture that existed in the strip initially upon full solidification.

At the conclusion of all the method steps, the strip comprises a microstructure (a) that has a b.c.c. phase, (b) that is substantially unrecrystallized and (c) that is predominantly dendritic with the longitudinal axis of the dendrites (19 in FIG. 3) being perpendicular to the plane of the strip surface.

Further with respect to grain growth, initially upon full solidification of the strip, dendrites 19 (FIG. 2) have an average diameter, in a plane parallel to surface 18 of strip 16, less than about $50\times10^{-6}$ m. Because there is no recrystallization during cooling to ambient temperature, following initial full solidification, the average grain diameter of the dendrites is substantially the same at ambient temperature as it was initially upon full solidification. The stress relief anneal produces at least some larger grains reflected by an average grain diameter, in a plane parallel to the surface of the strip, in the range $50–150\times10^{-6}$ m. A permissible range for the average grain diameter, in a plane parallel to the plane of the strip, would be in the range $10–200\times10^{-6}$ m.

Preferably, the grains have relatively uniform diameters after the annealing step rather than there being a bi-modal distribution of grain diameters in which one large group of grains has diameters substantially above the average and another large group has diameters substantially below the average.

Silicon is generally desireable in electrical steels because silicon improves the magnetic properties of the steel, among other reasons. In addition, the amount of silicon employed here acts as a ferrite stabilizer which (1) assures that, upon initial solidification, the steel has a b.c.c. phase and (2) assures that, during cooling to ambient temperature, the b.c.c. phase is maintained throughout the cooling step. A drawback to the inclusion of silicon in such amounts in most steels is that increased silicon content produces increased brittleness; and the more brittle the steel, the more likely it is to develop cracks during mechanical reduction.

However, when a steel strip is produced in accordance with embodiments of the present invention, there is no hot rolling (i.e. no substantial hot mechanical reduction) and cold rolling (i.e. cold mechanical reduction) is limited to temper rolling wherein the amount of cold mechanical reduction is less than about 10%, preferably less than about 5% and most preferably less than 1% (i.e. merely sufficient to bring about flattening).

Because of the limitations placed upon mechanical reduction in methods performed in accordance with the present invention, the steel can contain, at the time of the continuous strip casting step and thereafter, at least one alloying element (e.g. silicon) in an amount that embrittles the steel and would render it incapable of substantial mechanical reduction without cracking.

In other words, the steel contains enough silicon to have caused cracks to form during the mechanical reduction to which electrical steels are normally subjected. However, because of the constraints imposed upon mechanical reduction by a method in accordance with the present invention, no such cracks occur during performance of such a method, despite the high silicon content.

Thus, the steel may contain silicon in an amount substantially greater than 3 wt. %, even up to 20 wt. %, e.g. a silicon content in the range 10–20 wt. %. The upper limit of the silicon content is a function of the amount of cold mechanical reduction employed in temper rolling. The highest silicon content would be employed when the lowest percentage of mechanical reduction is employed during temper rolling, e.g. the percentage of cold reduction employed merely for flattening (0.5–1%). When the amount of cold mechanical reduction is near the high end of the temper rolling range (e.g., less than about 10% cold reduction, but more than about 5%), a more appropriate silicon content would be in the range 2–3 wt. %, for example.

In addition to the employment of ferrite stabilizers, such as silicon and the like, the steel composition may include, in addition to the elements described above, other elements heretofore employed in electrical steels, so long as those other elements do not have an adverse effect upon the characteristics (i.e. microstructure and crystalline texture) imparted to a steel strip produced in accordance with the present invention. One example of such an other element is antimony which may be employed in an amount in the range 0.02–0.10 wt. %, for example. Under certain conditions, antimony protects an electrical steel against internal oxidation of silicon, aluminum and manganese when the steel is annealed in an oxidizing atmosphere, such as that employed for decarburizing.

Although a steel in accordance with the present invention does not need to be decarburized, it does undergo a stress relief anneal, as described above. Moreover, after laminations are punched out from the steel strip, the laminations probably will undergo another stress relief anneal, e.g. by the lamination maker. The inclusion of antimony in the steel will protect the steel against internal oxidation in case there is an inadvertent intrusion into the annealing atmosphere of oxidizing gases. The employment of antimony to prevent internal oxidation during annealing is described in Lyudkovsky U.S. Pat. No. 4,421,574, for example, and the disclosure therein is incorporated herein by reference.

A steel strip produced in accordance with the present invention should have isotropic magnetic properties in a plane parallel to the plane of the steel strip. In other words, the magnetic properties in that plane should be the same in all directions. In addition, the strip should have a core loss of 1.0–1.5 Watts/lb. for a strip 0.018 inches thick, at an induction of 1.5 Tesla and a frequency of 60 Hertz. The strip should have a permeability in the range 3,750 to 6,250.

The foregoing detailed description has been given for clearness of understanding only and no unnecessary limitations should be understood therefrom, as modifications will be obvious to those skilled in the art.

I claim:

1. A method for producing an electrical steel strip having an aim final thickness from which core laminations for rotating electrical machinery or transformers are to be punched, said strip having a predominant crystalline texture characterized by a (100) plane of the unit cubes lying in a plane of the strip parallel to the surface of the steel strip with said {100} planes being randomly oriented in said plane of the strip, said method comprising the steps of:

providing a molten steel having a composition comprising sufficient ferrite stabilizer (a) to provide a body-centered-cubic (b.c.c.) phase in said steel initially upon solidification thereof and (b) to maintain said b.c.c. phase during cooling of the steel to ambient temperature following solidification;

subjecting said molten steel to a continuous strip casting step to produce a strip having an initial thickness less than about 120% of said aim final thickness;

said continuous strip casting step comprising solidifying said molten steel into a strip that, initially upon full solidification, comprises a predominantly dendritic steel microstructure having said b.c.c. phase and said predominant crystalline texture characterized by a (100) plane of the unit cubes lying in a strip plane parallel to the plane of the surface of the steel strip with said {100} planes being randomly oriented in said strip plane (a {100} <uvw> texture);

and providing said strip with said aim final thickness;

said method being devoid of any step after said continuous strip casting step which substantially changes said b.c.c. phase and said predominant crystalline texture that existed in said strip initially upon full solidification.

2. A method as recited in claim 1 and comprising:

cooling said strip to ambient temperature, after said continuous casting step, while substantially maintaining the b.c.c. phase and the predominant crystalline texture that existed initially upon full solidification;

cold reducing said strip by temper rolling to provide said aim final thickness of the strip;

and then annealing said strip under conditions that relieve stress and provide secondary grain growth while avoiding recrystallization.

3. A method as recited in claim 2 wherein:

said annealing step is conducted at an annealing temperature in the range 500°–650° C. (932°–1202° F.).

4. A method as recited in claim 1 or 2 wherein, at the conclusion of said method, said strip is characterized by:

isotropic magnetic properties in a plane parallel to the plane of the strip;

a core loss of 1.0–1.5 watts/lb. for a strip 0.018 in. thick, at an induction of 1.5 Tesla and a frequency of 60 Hertz;

and a permeability in the range 3750 to 6250.

5. A method as recited in claim 2 wherein:

initially upon said full solidification of said strip, the dendrites in said predominantly dendritic microstructure have an average diameter in a plane parallel to the surface of said strip, less than about $50\times10^{-6}$ m;

and said average grain diameter is substantially the same upon said cooling of the strip to ambient temperature as it was initially upon said full solidification.

6. A method as recited in claim 5 wherein:

said annealing step produces at least some larger grains reflected by an average grain diameter, in a plane parallel to the surface of said strip, in the range $50–150\times10^{-6}$ m.

7. A method as recited in claim 6 wherein:

after said annealing step, said strip has a relatively uniform grain diameter in a plane parallel to the plane of the strip.

8. A method as recited in claim 1 or 2 wherein:

said molten steel composition has a carbon content low enough to obviate the subsequent decarburization of said steel strip or of laminations punched from said steel strip.

9. A method as recited in claim 8 wherein:

said carbon content of the molten steel is substantially less than 0.01 wt. %.

10. A method as recited in claim 8 wherein:

said carbon content of the molten steel is less than 0.005 wt. %.

11. A method as recited in claim 1 or 2 wherein:

said steel contains, at the time of said continuous strip casting and thereafter, at least one alloying element that embrittles the steel and renders it incapable of substantial mechanical reduction, after solidification, without cracking;

said method being devoid of any such mechanical reduction.

12. A method as recited in claim 11 wherein:

said method is devoid of hot rolling and of any cold rolling step other than temper rolling.

13. A method as recited in claim 12 wherein:

said temper rolling step produces a reduction of less than about 5%.

14. A method as recited in claim 12 wherein:

said temper rolling step comprises flattening said strip with a reduction in the range 0.5–1.0%.

15. A method as recited in claim 12 wherein:

said embrittling element is silicon in an amount greater than 3 wt. % and up to 20 wt. %.

16. A method as recited in claim 15 wherein said silicon content is 10–20 wt. %.

17. A method as recited in claim 1 or 2 wherein said molten steel has a composition consisting essentially of in wt. %:

| | |
|---|---|
| carbon | less than 0.01 |
| manganese | 0.5 max. |
| sulfur | 0.005 max. |
| phosphorus | 0.02 max. |
| silicon | 1.5–10.0 |
| aluminum | 0–0.50 |
| iron | essentially the balance. |

18. A method as recited in claim 17 wherein said composition consists essentially of, in wt. %:

| | |
|---|---|
| carbon | less than 0.005 |
| manganese | 0.05–0.2 |
| sulfur | less than 0.001 |
| phosphorus | 0.002 max. |
| silicon | 2.0–3.0 |
| aluminum | less than 0.01 |
| iron | essentially the balance. |

19. A method as recited in claim 17 wherein:

said composition includes 0.02–0.10 wt. % antimony.

20. A method as recited in claim 17 wherein:

said composition comprises 2.0–3.0 wt. % silicon.

21. A method as recited in claim 1 or 2 and comprising:

limiting the wt. % of austenite stabilizers in said molten steel composition as follows:

| | |
|---|---|
| carbon | 0.01 max. |
| manganese | 0.20 max. |
| nickel | 0.05 max. |
| chromium | 0.05 max. |
| copper | 0.10 max. |

and providing said molten steel composition with at least one of the following ferrite stabilizers, in wt. %:

| | |
|---|---|
| silicon | 1.5–10.0 |
| aluminum | up to 5.0 |
| phosphorus | up to 2.0. |

22. A method as recited in claim 21 wherein:

said molten steel composition contains 1.5–10.0 wt. % silicon and at least one of (a) 0.5–5.0 wt. % aluminum and (b) 0.10–2.0 wt. % phosphorus.

23. A method as recited in claim 1 or 2 whereas:

said strip has an initial thickness less than about 110% of said aim final thickness;

and said method comprises cold reducing said strip no more than about 10% to provide said aim final thickness.

24. A method as recited in claim 23 wherein:

said strip has an aim final thickness in the range 0.010–0.100 in. (0.254–2.54 mm) and an initial thickness having a ratio to said final thickness in the range 101/100 to 110/100.

25. A method as recited in claim 24 wherein:

said initial thickness is no greater than about 0.08 in. (0.46 mm).

26. A method as recited in claim 1 or 2 wherein:

said strip has an initial thickness no more than about 101% of said aim final thickness;

and said method comprises flattening said strip by cold reduction of no more than about 1% to provide said aim final thickness.

27. A method as recited in claim 26 wherein:

said strip has an aim final thickness in the range 0.010–0.100 in. (0.254–2.54 mm) and an initial thickness having a ratio to said final thickness in the range 101/100 to 110/100.

28. A method as recited in claim 27 wherein:

said initial thickness is no greater than about 0.08 in. (0.46 mm).

29. A method as recited in claim 1 or 2 wherein:

said strip has an aim final thickness in the range 0.010–0.100 in. (0.254–2.54 mm) and an initial thickness having a ratio to said final thickness in the range 101/100 to 110/100.

30. A method as recited in claim 29 wherein:

said initial thickness is no greater than about 0.018 in. (0.46 mm).

* * * * *